US007242143B2

(12) United States Patent
Moon

(10) Patent No.: US 7,242,143 B2
(45) Date of Patent: Jul. 10, 2007

(54) PLASMA DISPLAY PANEL

(75) Inventor: Cheol-Hee Moon, Cheonan (KR)

(73) Assignee: Samsung SDI Co., Ltd., Sywon-si, Gyeonggi-do (KR)

( * ) Notice: Subject to any disclaimer, the term of this patent is extended or adjusted under 35 U.S.C. 154(b) by 210 days.

(21) Appl. No.: 10/669,748

(22) Filed: Sep. 25, 2003

(65) Prior Publication Data

US 2005/0067957 A1 Mar. 31, 2005

(30) Foreign Application Priority Data

Sep. 27, 2002 (KR) ..... 10-2002-0058892

(51) Int. Cl.
*H01J 17/49* (2006.01)

(52) U.S. Cl. ..... 313/583; 313/584; 313/292

(58) Field of Classification Search ..... 313/582–587, 313/292

See application file for complete search history.

(56) References Cited

U.S. PATENT DOCUMENTS 4,047,066 A * 9/1977 Kobayakawa et al. ..... 313/307
5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,786,794 A 7/1998 Kishi et al.
5,952,782 A 9/1999 Nanto
6,008,582 A * 12/1999 Asano et al. ..... 313/582
RE37,444 E 11/2001 Kanazawa
6,373,195 B1 * 4/2002 Whang et al. ..... 315/169.3
6,459,200 B1 * 10/2002 Moore ..... 313/582
6,495,958 B1 * 12/2002 Moon ..... 313/584

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commision, IEC. in 2003, and Appendix A—Description of Technology, Annex B—Relationship Between Voltage Terms And Discharge Characteristics; Annex C—Gaps and Annex D—Manufacturing.

*Primary Examiner*—Karabi Guharay
(74) *Attorney, Agent, or Firm*—Robert E. Bushnell, Esq.

(57) ABSTRACT

A plasma display panel includes a front substrate and a rear substrate opposing one another; display electrodes formed on the front substrate, a dielectric layer formed on the front substrate covering the display electrodes, barrier ribs formed on the rear substrate and including first barrier rib members formed in a direction orthogonal to the display electrodes, and second barrier rib members formed in a direction parallel to the display electrodes, the first barrier rib members intersecting the second barrier rib members to define discharge cells; phosphor layers formed in the discharge cells, and address electrodes realized through conductive wires and coated with a dielectric material, the address electrodes being formed orthogonal to the display electrodes in the discharge cells. The address electrodes may be mounted on the second barrier rib members orthogonal to the display electrodes in the discharge cells.

9 Claims, 5 Drawing Sheets

U.S. PATENT DOCUMENTS

| | | | | |
|---|---|---|---|---|
| 6,495,967 | B2 * | 12/2002 | Kao et al. | 315/169.4 |
| 6,608,441 | B2 * | 8/2003 | Kunii et al. | 313/584 |
| 6,630,916 | B1 | 10/2003 | Shinoda | |
| 6,670,757 | B2 * | 12/2003 | Kato et al. | 313/587 |
| 6,707,436 | B2 | 3/2004 | Setoguchi et al. | |
| 6,853,136 | B2 * | 2/2005 | Kim et al. | 313/582 |

FOREIGN PATENT DOCUMENTS

| | | | |
|---|---|---|---|
| JP | 9-306368 | | 11/1997 |
| JP | 2845183 | | 10/1998 |
| JP | 2917279 | | 4/1999 |
| JP | 11-126562 | | 5/1999 |
| JP | 2000-77002 | | 3/2000 |
| JP | 2000-182523 | | 6/2000 |
| JP | 2000-243303 | | 9/2000 |
| JP | 2001-043804 | | 2/2001 |
| JP | 2001076626 | A * | 3/2001 |
| JP | 2001-222958 | | 8/2001 |
| JP | 2001-291473 | | 10/2001 |
| JP | 2001-325888 | | 11/2001 |
| JP | 2001-345054 | | 12/2001 |
| JP | 2002-245943 | | 8/2002 |
| KR | 1996-0005684 | | 2/1996 |
| KR | 2000-0039002 | | 7/2000 |

* cited by examiner

PLASMA DISPLAY PANEL

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 27 Sep. 2002 and there duly assigned Serial No. 2002-58892.

BACKGROUND OF THE INVENTION

1. Field of the Invention

The present invention relates to a plasma display panel. More particularly, the present invention relates to a plasma display panel including discharge cells that are defined by barrier rib members formed on a rear substrate of the plasma display panel, in which the barrier rib members intersect and are parallel to display electrodes formed on a front substrate.

2. Description of the Related Art

A plasma display panel (PDP) is a display device that realizes the display of images by the illumination or excitation of phosphors by plasma discharge. Predetermined voltages are applied to electrodes formed on front and rear substrates of the PDP to realize plasma discharge in discharge cells defined by barrier ribs. Ultraviolet rays generated during discharge excite phosphor layers formed in a predetermined pattern to realize the display of visual images.

The PDP is classified into the two different types of the DC PDP and AC PDP, depending on the drive voltage waveform, that is, the discharge type. PDPs can be classified also as an opposing discharge PDP and a surface discharge PDP, depending on the electrode structure. The surface discharge PDP typically includes a front substrate and a rear substrate. Further, address electrodes are formed in a predetermined pattern on the rear substrate, and a dielectric layer is formed on the address electrodes. Barrier ribs are formed on the dielectric layer. The barrier ribs define discharge cells and prevent electrical and optical crosstalk between the cells. Phosphor layers are formed along at least one wall of each of the barrier ribs.

Display electrodes are formed in a predetermined pattern on a surface of the front substrate opposing the rear substrate. The display electrodes are orthogonal to the address electrodes. Further, the display electrodes are formed of a transparent material, and bus electrodes having a width that is less than a width of the display electrodes are formed on the display electrodes to reduce a line resistance of the same. A dielectric layer is formed covering the display electrodes and bus electrodes.

In the PDP structured as in the above, the barrier ribs define the discharge cells and prevent crosstalk between the discharge cells as described above, and also protect the discharge cells from external pressure applied during sealing of the front and rear substrates. If a height of the barrier ribs is increased, a size of the discharge cells is increased. This increases an area of deposition of the phosphor layers, which, in turn, enhances brightness. However, in the conventional stripe configuration of the barrier ribs (where the barrier ribs are aligned with the address electrodes), an increase in the height of the barrier ribs makes the space between the address electrodes and display electrodes greater. Since this increases an address voltage, there is a limit to how high the barrier ribs can be formed.

The applicant disclosed in U.S. Pat. No. 6,495,958 a plasma display panel that includes conductive wire electrodes such that power consumption is reduced during operation. This plasma display panel will be described with reference to FIG. 1.

As illustrated in the drawing, a PDP 100 includes a front substrate 102 and a rear substrate 104. Formed on a surface of the front substrate 102 opposing the rear substrate 104 are display electrodes 106 that include common electrodes 106*a* and scan electrodes 106*b*. A dielectric layer 108 is formed on the front substrate 102 covering the display electrodes 106, and a protection layer 110 such as a magnesium oxide layer is formed covering the dielectric layer 108. The common electrodes 106*a* and the scan electrodes 106*b* are formed in an alternating manner.

Barrier ribs 112 are formed in a stripe pattern on a surface of the rear substrate 104 opposing the front substrate 102. Discharge cells are formed between the barrier ribs 112. The barrier ribs 112 prevent crosstalk between the cells during discharge. Further, red, green, and blue phosphor layers 114 that are illuminated by discharge gas are formed in the discharge cells. Address electrodes 116 are formed on the phosphor layers 114 in a state orthogonal to the display electrodes 106 of the front substrate 102. The interaction between the address electrodes 116 and the discharge sustain (or display) electrodes 106 induces plasma discharges and has the phosphor illuminate in the neighborhood of the intersection of the address electrodes 116 and the display electrodes 106. The address electrodes 116 are formed as wires made of a conductive metal material such as aluminum, copper, gold, or white gold. The address electrodes 116 are coated with an insulation 118.

In the PDP 100 structured as described above, since the address electrodes 116 are mounted on the phosphor layers 114, the space between the address electrodes 116 and the display electrodes 106 may be reduced over more conventional PDPs in which the address electrodes are covered by a dielectric layer. Accordingly, the amount of power consumed may be reduced during operation of the PDP in proportion to the reduction in the space between the address electrodes 116 and the display electrodes 106. Also, the barrier ribs 112 may be formed to a greater height such that the discharge cells and the phosphor deposition area are increased to enhance brightness and realize more stable discharge.

However, a drawback of the above configuration is that terminal areas of the wire-type address electrodes 116 that protrude to the outside of the PDP are secured only by a sealant used to seal the substrates 102 and 104. This may result in the terminal areas of the address electrodes 116 from becoming unaligned during the sealing process so that a distance between the terminal areas varies from one terminal to the next.

SUMMARY OF THE INVENTION

It is therefore an object of the present invention to provide a design for a PDP that results in less power consumption during operation of the PDP.

It is further an object of the present invention to provide a design for a PDP where the amount of power consumption to drive the PDP can be controlled.

It is also an object of the present invention to provide a design for a PDP where image quality is enhanced.

It is yet an object of the present invention to provide a design for a PDP where the brightness of the image can be controlled.

It is further an object of the present invention to provide a design for a PDP where the brightness of the image is enhanced.

It is still yet another object of the present invention to provide a design for a PDP where the possibility of shorting the address electrodes is reduced.

These and other objects may be achieved by a design for a PDP that has two sets of barrier ribs formed on or in the rear substrate, each set of barrier ribs runs orthogonal to barrier ribs of the other set. These two sets of barrier ribs form an array of discharge cells where phosphor is placed therein to coat the side walls of the barrier ribs and the bottoms of the discharge cells. Each discharge cell is completely surrounded by the barrier ribs. The address electrodes are disposed in the rear substrate over one of the two sets of the barrier ribs but parallel to the other set of barrier ribs. The address electrodes being orthogonal to the display electrodes formed in the front substrate when the rear and the front substrates are combined. The array of discharge cells may be rectangular in shape, may be staggered from row to row (delta configuration), or may be hexagonal in shape.

After formation of both sets of barrier ribs, each discharge cell is coated with phosphor before laying the address electrodes. With this instant design, the phosphor may cover more area in each discharge cell causing the image to be brighter.

The amount of voltage and power that is needed to drive the address electrodes can be reduced by diminishing the distance between the display electrodes and the address electrodes. This distance can be diminished if the barrier rib set that supports the address electrode (t2) is high and if the set that runs parallel to the address electrode (t1) is reduced. By varying the heights t1 and t2 of the first and second barrier rib members respectively, the PDP can be designed to achieve a certain amount of power consumption by the address electrodes to drive the PDP. Heights t1 and t2 can be modified to change the amount of area coated by phosphor, which effects image brightness. The gap and the image quality can be further enhanced by having the address electrode reside in a cut out portion of the second set of barrier ribs instead of being disposed on top of them.

The design may further be enhanced by providing conductive address electrodes coated with a dielectric. The address electrodes may further be coated with a layer of phosphor to further enhance image quality. The conductive address electrode may have a circular or polygonal cross section.

The design may yet further be enhanced by securing terminal ends of the address electrodes. At ends of the rear substrate, a cut out or a fixing groove may be formed in the substrate at an edge of the substrate for securing terminal ends of the address electrode. The terminal end of the address electrode may be placed in the cut out or the fixing groove formed in the rear substrate and an adhesive, like an adhesive tape may then be used to secure the terminal end of the address electrode to the fixing groove in the rear substrate to prevent shorting of the address electrodes and to maintain the distance and alignment between the address electrode and the display electrodes.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 2:
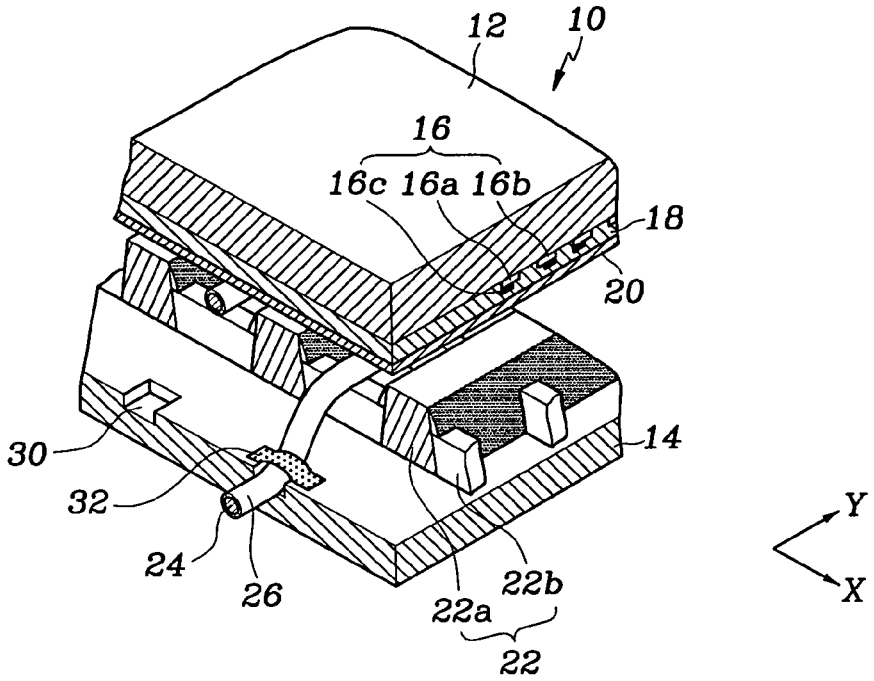
FIG. 2 is a perspective view of a plasma display panel according to an embodiment of the present invention, in which substrates of the plasma display panel are illustrated in a separated state.

Turning now to FIG. 2, FIG. 2 is a perspective view of a plasma display panel according to an embodiment of the present invention, in which substrates of the plasma display panel are illustrated in a separated state. A plasma display panel (PDP) 10 of FIG. 3 includes a front substrate 12 and a rear substrate 14 both made of glass and provided opposing one another. Formed on a surface of the front substrate 12 opposing the rear substrate 14 are display electrodes 16, which include common electrodes 16*a*, scan electrodes 16*b*, and bus electrodes 16*c*. The common electrodes 16*a* and the scan electrodes 16*b* are formed in a stripe pattern and in an alternating manner. One of the bus electrodes 16*c*, which are made of a metal material, is formed on each of the common electrodes 16*a* and the scan electrodes 16*b*. A dielectric layer 18 is formed over an entire surface of the front substrate 12 covering the display electrodes 16. A protection layer 20 is formed covering the dielectric layer 18 to protect the same and therefore increase the life of the PDP 10. The protection layer 20 also minimizes a reduction in and improves an efficiency of a drive voltage used for secondary electron emission. The protection layer 20 may be made of a magnesium oxide film.

Figure 1:
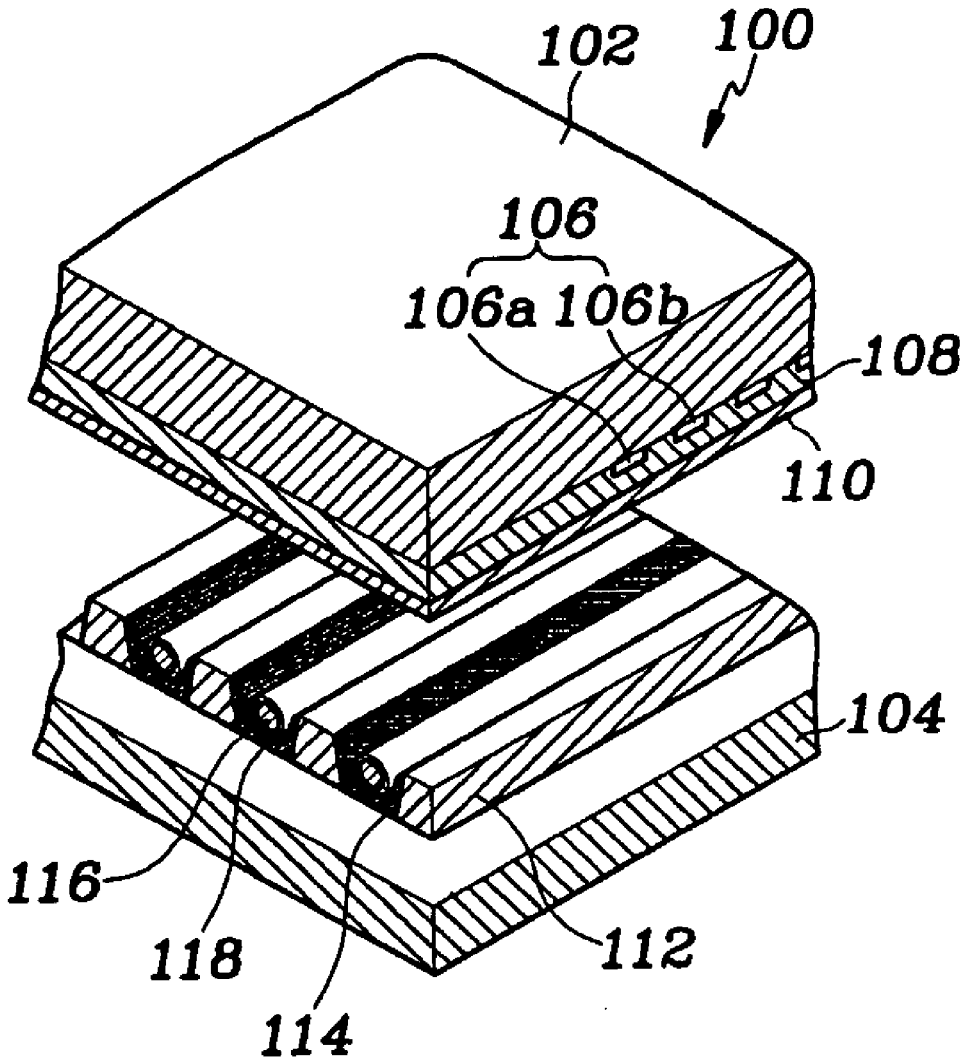
FIG. 1 (Prior Art)
FIG. 1 is a perspective view of a plasma display panel of an application filed prior to the present application, in which substrates of the plasma display panel is illustrated in a separated state.

Formed on a surface of the rear substrate 14 opposing the front substrate 12 are barrier ribs 22. The barrier ribs 22 form discharge cells and prevent crosstalk between the cells during discharge. The barrier ribs 22 include first barrier rib members 22*a* formed along an axis Y direction to be orthogonal to the display electrodes 16, and second barrier rib members 22*b* formed along an axis X direction to be parallel with the display electrodes 16. The first barrier rib members 22*a* intersect the second barrier rib members 22*b* to form areas enclosed by these elements, that is, to form discharge cells. These discharge cells, unlike the discharge cells in FIG. 1, are bounded on all sides (closed in completely) by barrier rib members. Unlike the arrangement of FIG. 1, the arrangement of FIG. 3 and the presence of second barrier rib members 22*b* improves the efficiency of discharge by better defining the discharge space more compactly than the arrangement of FIG. 1. The arrangement of FIG. 3 also allows for a broadening of area that phosphors exist as compared to the arrangement of FIG. 1. As will be discussed later, the shape of the discharge cells defined by the first and the second barrier rib members, can be rectangular, circular, hexagonal, polygonal, staggered or any other shape.

Figure 3:
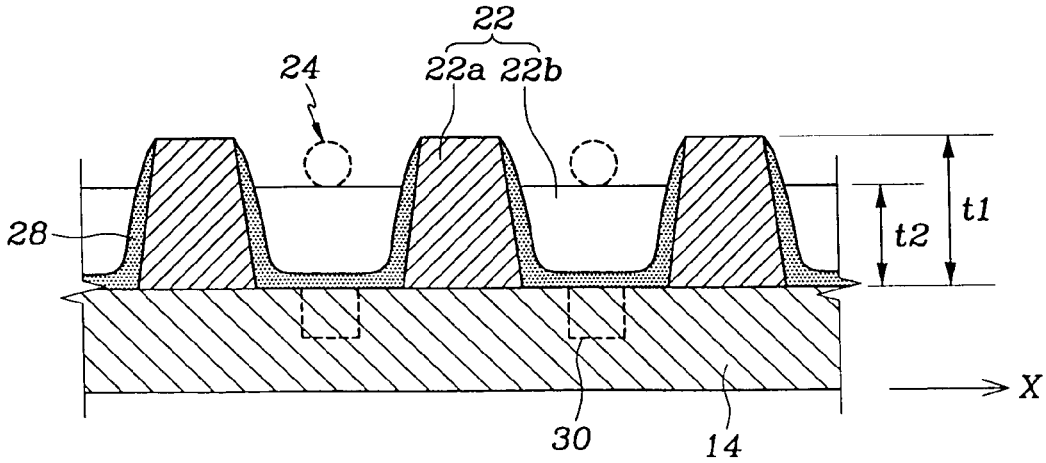
FIG. 3 is a sectional view of a rear substrate of the plasma display panel of FIG. 2 illustrated from a Y axis direction.

With reference to FIG. 3, a height t2 of the second barrier rib members 22*b* is less than a height t1 of the first barrier rib members 22*a*. The height t2 is significant as the address electrodes 24 are disposed on top of the second barrier rib members 22*b*. Thus, the height t2 of the second barrier rib members 22*b* can effect the distance between the address electrodes 24 and the display electrodes 16 in the final PDP structure. The height t1 of the first barrier rib member 22*a* is also significant at t1 also will effect the distance between the address electrodes 24 and the display electrodes 16. Heights t1 and t2 can also influence the amount of phosphor that can be deposited into each discharge cell. Therefore, by varying t1 and t2, the distance between address and display electrodes can be tuned to achieve a desired drive voltage for the address electrodes. Also, by varying t1 and t2, the amount of phosphor that can be deposited in the discharge cell and the surface area the phosphor covers can be varied, thus tuning the brightness of the image on the PDP. Also, by varying t1 and t2, the size of the hole for venting gas can also be finely tuned.

In FIG. 3, the fact that t2 is less than t1 allows for the smooth exhaust of discharge gas generated inside the discharge cells, and permits the easy mounting of address electrodes 24 on the second barrier rib members 22*b*.

The address electrodes 24 are formed as wires made of a conductive metal material such as aluminum, copper, gold, or white gold. The address electrodes 24 may also be made of wires coated with such a metal material. The address electrodes 24 are coated with a dielectric material 26. The conductive wire forming the address electrodes 24 is circular or elliptical in cross section. However, the present invention is not limited to such a configuration and other polygonal shapes may be used such as a wire having a quadrilateral or pentagonal cross section. Red, green, and blue phosphor layers 28 are deposited to a predetermined thickness in the discharge cells defined by the first barrier rib members 22*a* and the second barrier rib members 22*b*.

Fixing grooves 30 are formed in edges of the rear substrate 14. That is, the fixing grooves 30 are formed in the rear substrate 14 at areas corresponding to terminal areas of the address electrodes 24, and the terminal areas of the address electrodes 24 are inserted into the fixing grooves 30 so that the address electrodes 24 are firmly held in place. This ensures that the address electrodes 24 remain aligned when the front substrate 12 and the rear substrate 14 are assembled. The fixing grooves 30 maybe formed in the rear substrate 14 by a sandblasting or etching process. An adhesive member 32 such as adhesive tape or adhesive paste may be further provided over the terminal areas of the address electrodes 24 or in the fixing grooves 30 to better secure the terminal areas of the address electrodes 24 in the fixing grooves 30.

In the PDP 10 structured as in the above, the closed barrier rib structure is used as described above, and by varying the height t2 of the second barrier rib members 22*b*, a height of the address electrodes 24 is also easily varied, thereby varying the distance between the address electrodes 24 and the display electrodes 16. Accordingly, if the height t1 of the first barrier rib members 22*a* is increased to enlarge the size of the discharge cells and increase the phosphor deposition area, the distance between the address electrodes 24 and the display electrodes 16 may be minimized by increasing the height t2 of the second barrier rib members 22*b* to thereby lower an address discharge voltage and an addressing time.

Further, with the provision of the fixing grooves 30 that secure the terminal areas of the address electrodes 24, the terminals of the address electrodes 24 remain aligned during assembly of the front and rear substrates 12 and 14. This prevents a short from developing in the address electrodes 24.

Figure 4:
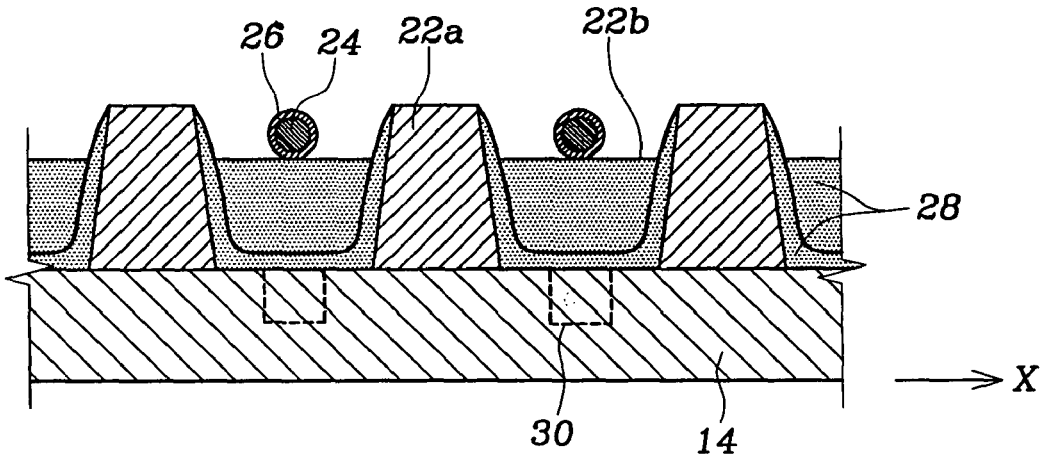
FIG. 4 is a sectional view of a modified example of the rear substrate of FIG. 3.
Figure 5:
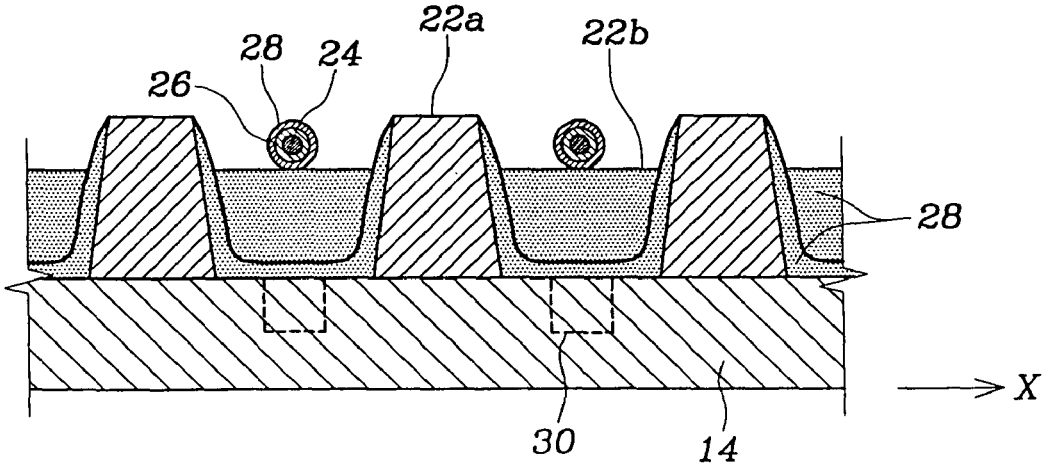
FIG. 5 is a sectional view of another modified example of the rear substrate of FIG. 3.

FIGS. 4 and 5 illustrate modified examples of the PDP 10 of FIG. 4. In the PDP of FIG. 4, the phosphor layers 28 are formed along inner walls of not only the first barrier rib members 22*a* but along inner walls also of the second barrier rib members 22*b*. That is, the phosphor layers 28 are deposited within all of the discharge cells. The address electrodes 24 are realized through conductive wires coated with a dielectric material 26, and are mounted on the second barrier wall members 22*b* as in the PDP of FIG. 3.

In the PDP of FIG. 5, the address electrodes 24 are wires coated with a dielectric material 26 and a phosphor layer 28. That is, the address electrodes 24 are conductive wires coated first with the dielectric material 26 then with the phosphor layer 28. It is preferable that the phosphor layer 28 is identical in color to the phosphor layer 28 coated in the corresponding discharge cell. Since the phosphor layers 28 are coated over the address electrodes 24 in addition to forming the phosphor layers 28 along inner walls of the first and second barrier rib members 22*a* and 22*b*, the areas of deposition of the phosphor material is further increased.

Figure 6:
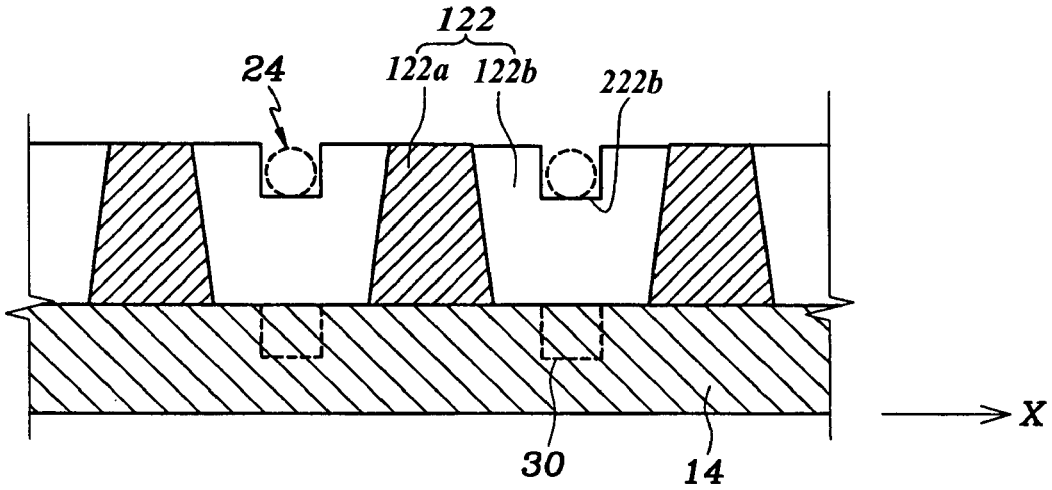
FIG. 6 is a sectional view of a rear substrate of a plasma display panel according to another embodiment of the present invention.
Figure 7:
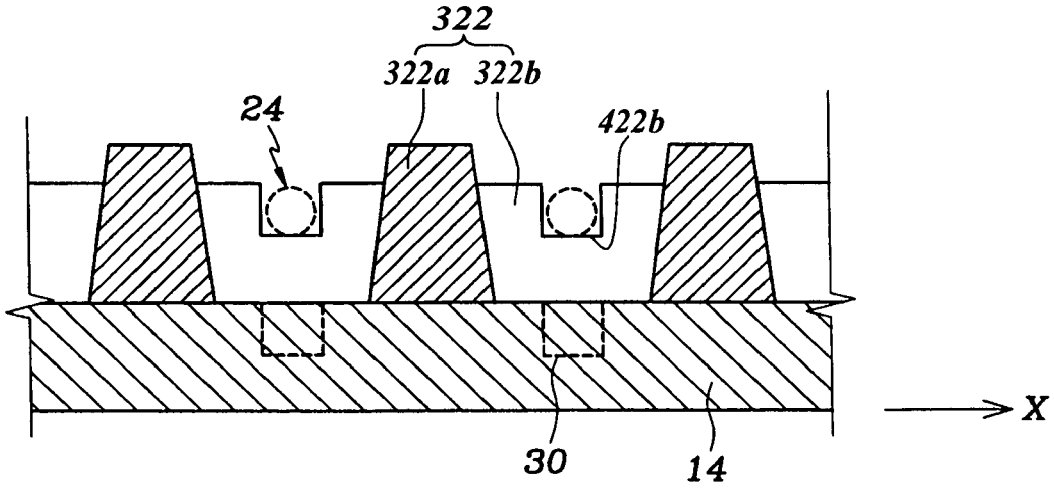
FIG. 7 is a sectional view of a rear substrate of a plasma display panel according to yet another embodiment of the present invention.

FIG. 6 is a sectional view of a rear substrate of a PDP according to another embodiment of the present invention. The PDP is illustrated in a state before phosphor layers are deposited. Barrier ribs 122 include first barrier rib members 122*a* and second barrier rib members 122*b*, which are formed to the same height as the first barrier rib members 122*a*. Grooves 222*b* into which address electrodes 24 are inserted are formed in distal ends of the second barrier rib members 122*b*. The rest of the structure is identical to the PDP of FIG. 3.

Figure 8:
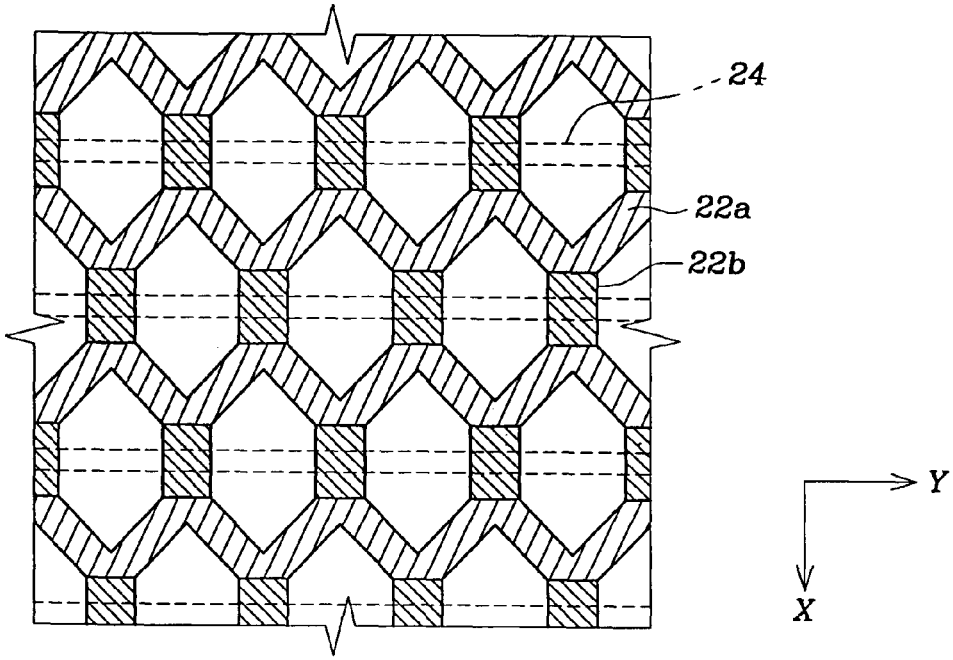
FIG. 8 is a plane view of a rear substrate in which discharge cells are formed in the shape of a hexagon according to an embodiment of the present invention.

FIG. 8 is a sectional view of a rear substrate of a plasma display panel according to yet another embodiment of the present invention. A height of second barrier rib members 322*b* is less than a height of first barrier rib members 322. Also, fixing grooves 422*b* are formed in distal ends of the second barrier rib members 322*b*. The rest of the structure is identical to the PDP of FIGS. 3 and 4.

The barrier ribs for the PDP of the above embodiments may be formed by coating a barrier rib paste to a predetermined height, laminating the paste with a dry film resist, exposing and developing the resulting structure, then performing sandblasting. Heights of the first and second barrier rib members may be made different by changing a line width of the dry film resist, or by pattern printing the barrier rib paste where the first barrier rib members are to be formed to increase the height of the first barrier rib members. The barrier ribs may also be formed by cutting the glass substrates, or by using a mold to form barrier rib paste to the desired shape.

In the embodiments of the present invention, the discharge cells are described as being formed as quadrilateral shapes when viewed from above. However, when the above basic structure of placing wire-shaped address electrodes over barrier rib members is used, the present invention is not limited to such a configuration and the discharge cells may be formed to other shapes by the barrier ribs.

Figure 9:
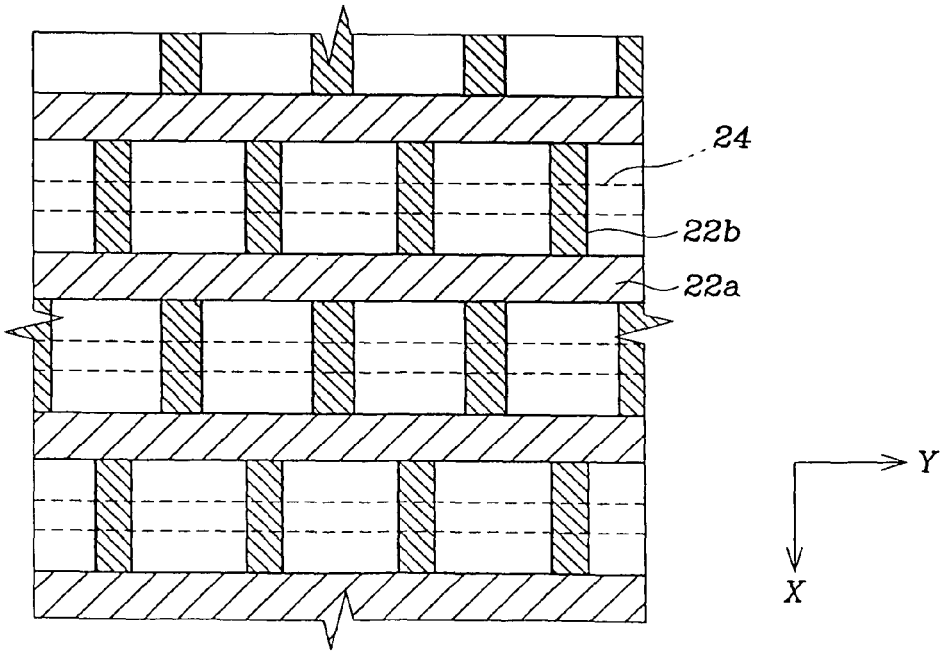
FIG. 9 is a plane view of a rear substrate in which discharge cells are formed in a delta arrangement structure according to an embodiment of the present invention.

In more detail, the discharge cells may be formed in the shape of a hexagon as illustrated in FIG. 8, or may be formed in a delta arrangement or staggered rectangular structure as illustrated in FIG. 9. Wires forming address electrodes in either case may be formed having a cross section that is rounded or polygonal (e.g., a rectangle or hexagon).

With reference to FIG. 8, first barrier rib members are formed in a zigzag configuration along an axis Y direction, and second barrier rib members are formed interconnecting adjacent first barrier rib members at predetermined areas by extending in an axis X direction. Wire-shaped address electrodes 24 are arranged along the axis Y direction and are positioned lying over the second barrier rib members.

With reference to FIG. 9, first barrier rib members are formed at predetermined intervals in a stripe pattern and along an axis Y direction. Second barrier rib members are formed extending between adjacent first barrier rib members at predetermined intervals and along an axis X direction. The second barrier rib members are unaligned in the axis X direction from between one pair of the first barrier rib members to between an adjacent pair of the first barrier rib members. Wire-shaped address electrodes 24 are arranged along the axis Y direction and are positioned lying over the second barrier rib members.

In the PDP of the present invention described above, the address voltage is not increased and the discharge cells are enlarged by increasing the height of the barrier ribs such that the addressing time is reduced, the discharge quality is improved, and the brightness is increased by the resulting increase in the phosphor deposition area.

Further, with the formation of the fixing grooves to secure the terminal areas of the address electrodes, the address electrodes remain aligned during the assembly of the front and rear substrates to thereby prevent the shorting of the address electrodes.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A plasma display panel, comprising:

a front substrate and a rear substrate opposing one another with a predetermined gap therebetween;

a plurality of display electrodes formed on the front substrate;

a dielectric layer formed on the front substrate covering the display electrodes;

a plurality of barrier ribs formed on the rear substrate and comprising a plurality of first barrier rib members formed in a direction orthogonal to the display electrodes, and a plurality of second barrier rib members formed in a direction parallel to the display electrodes, the first barrier rib members intersecting the second barrier rib members, the plurality of barrier ribs forming an array of discharge cells, each discharge cell being bounded by a pair of first barrier rib members and a pair of second barrier rib members;

a phosphor layer being formed in respective discharge cells; and address electrodes comprising conductive wires and coated with a dielectric material, the address electrodes being mounted on the second barrier rib members, the address electrodes being orthogonal to the display electrodes, wherein grooves are formed in distal ends of the second barrier rib members into which the address electrodes are inserted.

2. The plasma display panel of claim 1, wherein a height t2 of the second barrier rib members are less than a height t1 of the first barrier rib members.

3. The plasma display panel of claim 1, wherein a phosphor layer surrounds an outer circumference of the dielectric material that, in turn, surrounds the address electrodes.

4. The plasma display panel of claim 1, wherein the conductive wires forming the address electrodes are circular in cross section.

5. The plasma display panel of claim 1, wherein the conductive wires forming the address electrodes are polygonal in cross section.

6. The plasma display panel of claim 1, each of the address electrodes running orthogonal to the second barrier rib members.

7. A plasma display panel comprising;

a front substrate and a rear substrate opposing one another with a predetermined gap therebetween;

a plurality of display electrodes formed on the front substrate;

a dielectric layer formed on the front substrate covering the display electrodes;

a plurality of barrier ribs formed on the rear substrate and comprising a plurality of first barrier rib members formed in a direction orthogonal to the display electrodes, and a plurality of second barrier rib members formed in a direction parallel to the display electrodes, the first barrier rib members intersecting the second barrier rib members, the plurality of barrier ribs forming an array of discharge cells, each discharge cell being bounded by a pair of first barrier rib members and a pair of second barrier rib members;

a phosphor layer being formed in respective discharge cells;

address electrodes comprising conductive wires and coated with a dielectric material, the address electrodes being mounted on the second barrier rib members, the address electrodes being orthogonal to the display electrodes; and fixing grooves formed in edges of the rear substrate at areas corresponding to terminal areas of each of the address electrodes, the fixing grooves securing the terminal areas of the address electrodes, wherein grooves are formed in distal ends of the second barrier rib members into which the address electrodes are inserted.

8. The plasma display panel of claim 7, wherein the terminal areas of the address electrodes positioned in the fixing grooves are further secured by an adhesive member.

9. A plasma display panel, comprising:

a front substrate and a rear substrate opposing one another with a predetermined gap therebetween;

a plurality of display electrodes formed on the front substrate;

a dielectric layer formed on the front substrate covering the display electrodes;

a plurality of first barrier ribs and a plurality of second barrier ribs formed on the rear substrate essentially perpendicular to each other forming an array of discharge cells, each discharge cell being completely surrounded by said first and said second barrier ribs;

a plurality of phosphor layers formed in the discharge cells; and a plurality of electrically conductive address electrodes being formed orthogonal to the display electrodes in the discharge cells, said address electrodes being parallel to said first barrier ribs, wherein the discharge cells defined by the first barrier ribs and the second barrier ribs are rectangular and staggered to discharge cells on an opposite side of a first barrier rib, wherein grooves are formed in distal ends of the second barrier rib members into which the address electrodes are inserted.

* * * * *